United States Patent [19]

Capra et al.

[11] 4,162,030

[45] Jul. 24, 1979

[54] DISPOSABLE PACKAGE DISPENSER HAVING A PRESSURE RELEASE CHANNEL

[75] Inventors: Nicholas G. Capra, East Hanover, N.J.; Ronald L. Antenore, Coral Gables, Fla.

[73] Assignee: J. Claybrook Lewis and Associates, Ltd.

[21] Appl. No.: 789,552

[22] Filed: Apr. 20, 1977

[51] Int. Cl.[2] ..... B05B 11/02

[52] U.S. Cl. ..... 222/321; 222/381; 222/386.5; 222/397; 239/323; 417/273

[58] Field of Search ..... 222/183, 184, 94, 95, 222/96, 105, 106, 107, 209, 321, 380, 381, 383, 386.5, 389, 397, 401, 520, 521, 525, 549; 239/323; 417/273, 496, 566

[56] References Cited

U.S. PATENT DOCUMENTS

| | | | |
|---|---|---|---|
| 2,223,256 | 11/1940 | Kross | 222/209 X |
| 2,461,121 | 2/1949 | Markham | 417/273 |
| 2,859,899 | 11/1958 | Kramer et al. | 222/95 |
| 3,145,879 | 8/1964 | Williams | 222/184 |
| 3,417,901 | 12/1968 | Sands | 222/95 |
| 3,430,817 | 3/1969 | Falkenberg | 222/209 X |
| 3,459,335 | 8/1969 | Cohen et al. | 222/209 X |
| 3,592,365 | 7/1971 | Schwartzman | 222/209 |
| 3,792,800 | 2/1974 | Capra et al. | 222/321 X |
| 3,871,553 | 3/1975 | Steinberg | 222/95 |
| 3,876,119 | 4/1975 | Lampkin | 222/386.5 |

*Primary Examiner*—Robert J. Spar
*Assistant Examiner*—Fred Silverberg
*Attorney, Agent, or Firm*—Dennis H. Lambert

[57] ABSTRACT

A disposable package dispenser comprises a replaceable, collapsible, prefilled package of the product to be dispensed, and includes a product discharge member and attachment structure for releasably attaching the package to a pressurizable dispensing container. The container includes a manually operable expansible chamber to pressurize the interior of the container and thus the collapsible product containing package to collapse the package and effect pressurized discharge of the product when the discharge member is operated.

14 Claims, 16 Drawing Figures

DISPOSABLE PACKAGE DISPENSER HAVING A PRESSURE RELEASE CHANNEL

BACKGROUND OF THE INVENTION

This invention relates generally to dispensers for pressurized discharge of materials, and more particularly relates to a dispenser which does not rely upon the use of aerosol propellents, which are coming under increasing attack for their potential harm to the environment and other problems associated therewith. For example, the hydrocarbon propellents are highly flammable and explosive and present a problem from both a packaging and formulation viewpoint. Additionally, the conventional aerosol propellents require containers capable of withstanding substantial internal pressures, and thus the design of such containers is relatively limited.

Other types of pressurized dispensers found in the prior art utilize finger operated pumps or trigger operated sprays and the like or squeeze containers for dispensing product under pressure. However, these types of dispensers possess several disadvantages, in that finger fatigue is experienced with the finger operated plungers or pumps and, moreover, accurate and well regulated sprays or discharges of the material cannot easily be accomplished. Additionally, the mist or spray effected with such prior art devices is relatively wet and not suitable for many uses.

The present invention, on the other hand, provides a unique disposable package dispenser which is releasably applied to and removed from a pressurizable container having pump means associated therewith for quickly and easily producing a relatively high pressure inside the container to pressurize the contents of the dispenser package, whereby the contents may be discharged or dispensed under pressure when a discharge valve or nozzle is operated. The disposable package containing the product is replaceable, whereby the same pressurizable container can be used for dispensing many different products, with one product being conveniently stored while another is being dispensed with the container. Further, sterile or sanitary prefilled disposable packages can be provided which may be quickly and easily attached to the dispensing container to maintain a sterile or sanitary environment, as, for example, in the food or medical art.

OBJECTS OF THE INVENTION

It is, therefore, an object of the invention to provide a disposable package dispenser which includes a pressurizable container having means for releasably securing thereto a collapsible product containing package, whereby the interior of the container may be selectively pressurized to pressurize the contents of the package, and thereby effect release of the product when a discharge valve is operated.

Another object of the invention is to provide a pressurizable container for releasably receiving a product containing package therein and wherein different packages can be substituted in the container for use of the container with interchangeable products.

A still further object of the invention is to provide a disposable package dispenser wherein a collapsible product containing package may be maintained sterile or sanitary until use is required and then releasably secured to a pressurizable container for discharge of the material from the package.

Still a further object of the invention is to provide a disposable package dispenser wherein a product is prefilled in a collapsible package and the package sealed for subsequent use when assembled to a pressurizable container, thus preventing product contamination.

A still further object of the invention is to provide a product dispenser which is economical in construction and which is convenient to use, and which includes a replaceable or interchangeable product containing package for use of the dispenser in dispensing food, medicine, cosmetics or industrial and other products as desired.

Yet another object of the invention is to provide a disposable package dispenser for dispensing various products wherein the dispenser includes a pressurizable container that is reusable for further product packages and which is selectively pressurized by the user to obtain a high pressure discharge of the product without the use of aerosol propellents and the like, and which is therefore less harmful to the ecology than prior art aerosol devices.

DETAILED DESCRIPTION OF THE INVENTION

Figure 1:
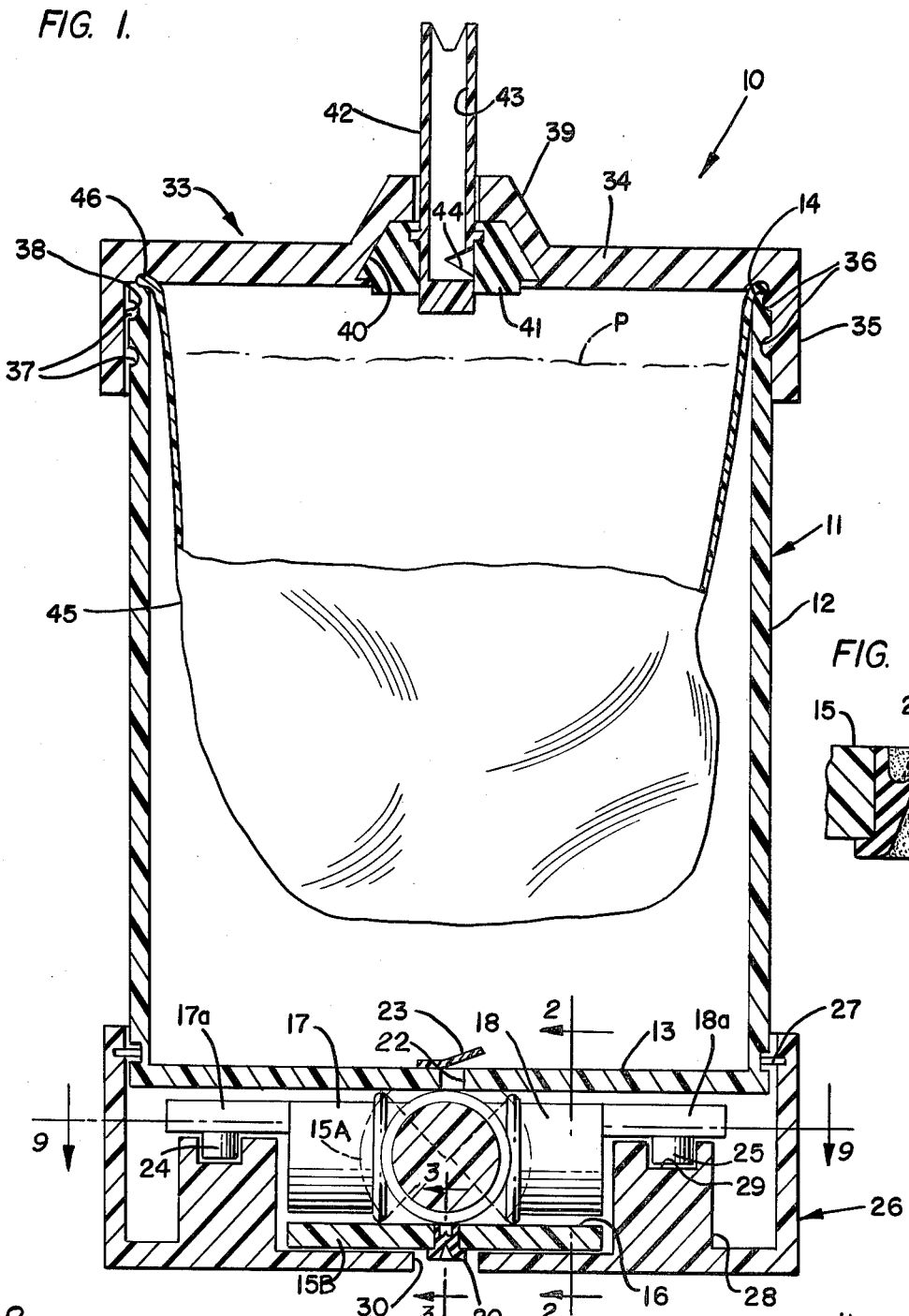
FIG. 1 is a view in section of a first form of the invention.
Figure 3:
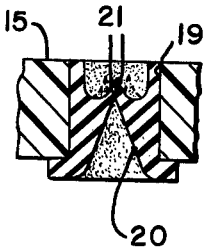
FIG. 3 is a greatly enlarged fragmentary view in section taken along line 3—3 of FIG. 1.

In the drawings, wherein like reference numerals indicate like parts throughout the several views, a disposable package dispenser is indicated generally at 10 and comprises a pressurizable container 11 having a side wall 12, a closed bottom 13 and an open top 14. A pair of intersecting open ended cylindrical walls 15A and 15B are formed on the bottom 13 of the container 11 and define a pair of mutually perpendicular piston cylinders or chambers 16A and 16B therein in which respective pairs of opposed pistons 17, 18 and 17', 18' are reciprocably mounted. An inlet opening 19 is formed at the juncture of the cylindrical walls between the pistons and a resilient valve member 20 having flexible closure lips 21 is fitted within the opening 19 for controlling flow of air into the piston chambers 16A and 16B between the pistons. An outlet opening 22 is formed in the bottom wall 13 of container 11 establishing communication between the piston chambers and the interior of the container and flow through the outlet opening 22 is controlled by a flap valve 23, shown in open position in full lines, and in closed position in dot and dash lines, in FIG. 2.

The pistons 17, 17' and 18, 18' have rearwardly extending projections **17*a*, 18*a* and 17*a'* 18*a'*, respectively, having downwardly projecting posts 24 and 25 thereon. A piston actuating cap 26 is rotatably secured on the bottom end of container 11 by means of a snap ring 27 or other suitable structure interengaged between the actuating cap 26 and the bottom end of container 11. The actuating cap 26 has an upstanding serpentine rib or wall 28 therein on the interior bottom surface thereof with a similarly shaped serpentine channel or cam track 29 formed in the upper surface thereof and in which the posts 24 and 25 on the pistons 17, 17' and 18, 18' are received, whereby when the actuating cap 26 is rotated relative to the container 11, the pistons are caused to reciprocate in unison to alternately draw atmospheric air in through the valve member 20 and into the piston chambers and to then expel the air outwardly through opening 22 and past valve 23 into the interior of the container 11. The bottom or end wall of actuating cap 26 has a central opening 30 therethrough enabling atmospheric air to flow inwardly through the valve 20 to the piston chambers 16A and 16B**.

Figure 2:
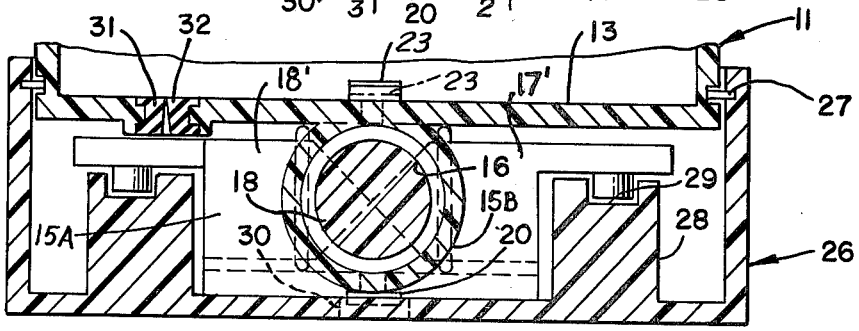
FIG. 2 is a fragmentary view in section taken along line 2—2 in FIG. 1.

As seen in FIG. 2, a pressure relief opening 31 is also formed in the bottom wall 13 of container 11 and a resilient valve member 32 is secured therein for normally maintaining the opening 31 closed. However, in the event the pistons are actuated to an extent whereby an excessive pressure is developed within the container 11, the resilient valve member 32 opens to enable escape of the excess pressure. If desired, the pistons may be sized such that a pressure ratio is obtained whereby overcharge is not possible, even without the pressure relief opening.

A disposable product package 33 is releasably secured to the other or open top end 14 of container 11 and comprises a cap member 34 having an annular depending skirt 35 with suitable fastening means 36, such as threads or the like, on the inner surface thereof for cooperation with similar fastening means or threads 37 on the outer surface of the top end of container 11. A passage or channel 38 is formed through the threads in the cap 34 to enable release of pressure from within the container when the cap 34 is removed, whereby the pressure is bled off through the channel 38 as soon as the seal is broken between the cap 34 and the open upper end 14 of the container and prior to the time the fastening means 36 and 37 become completely disengaged.

An upstanding, frusto-conically shaped projection 39 is formed in the center of the cap 34 and defines a correspondingly shaped pocket or cavity 40 therein in which a resilient plug 41 is suitably secured. The plug 41 carries a discharge nozzle 42 having an axial bore 43 therethrough and a notch or slot 44 in one side thereof communicating with the bore or passage 43 and normally closed by the plug 41.

A flexible, collapsible package or bag 45 is suitably secured at an open upper end 46 thereof with the underside of the cap 34 and the bag is prefilled with a product P. Thus, the product-filled bag or package 45 and the cap 34 are assembled and removed as a unit to and from the container 11.

Figure 4:
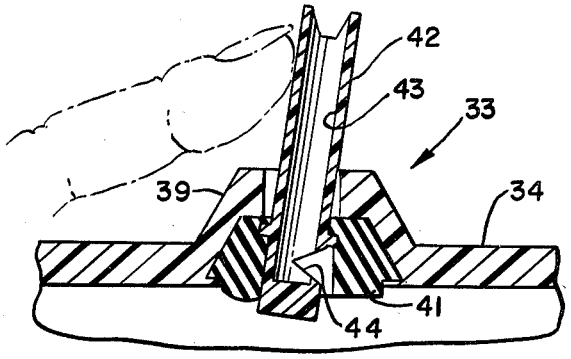
FIG. 4 is a fragmentary view in section showing the dispensing nozzle in its open or actuated position.

In use, a disposable dispenser 33 having a collapsible package or bag 45 prefilled with a suitable product P is selected and assembled to a pressurizable container 11. When it is desired to discharge or dispense the product P, the actuating cap 26 is rotated in either of two directions or alternately in both directions to cause operation of the pistons to pressurize the interior of the container 11. Inasmuch as the area of the pistons is considerably less than the area of the collapsible package 45, a pneumatic advantage is obtained, whereby the pressure generated by the pistons results in a much greater force being applied on the contents of the bag or package 45 than is required to operate the pistons. When a suitable pressure has been reached by operation of the actuating cap 26, the discharge nozzle or tube 42 is tilted to one side, as illustrated in FIG. 4, establishing communication between the notch 44 and the interior of the package or bag 45, thus enabling the product P to escape through the notch or slot 44 and the bore 43 in the discharge nozzle 42.

Figure 5:
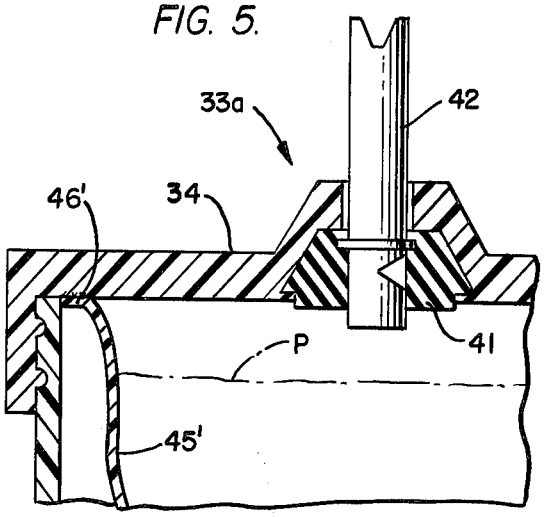
FIG. 5 is a fragmentary view in section of a second form of the invention showing a different method of attachment of the collapsible product containing package to the cap for the container.

A slightly modified form of the invention **33*a* is shown in FIG. 5, and in this form of the invention the package 45' has its open upper end 46' cemented or otherwise suitably bonded or secured to the undersurface of cap 34, and rather than a bead 46 received in a shallow groove or channel as in the FIG. 1 embodiment, the open upper end 46' simply comprises a flat annular flange which is secured against the underside of cap 34**.

Figure 6:
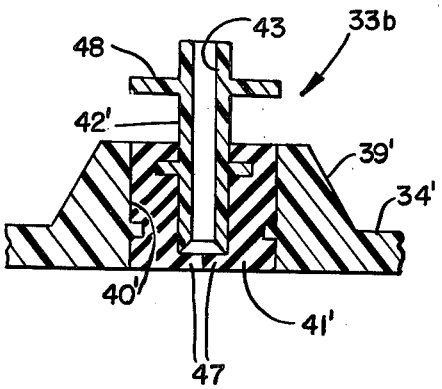
FIG. 6 is a greatly enlarged fragmentary view in section of a modified discharge means or nozzle for use with the invention.
Figure 9:
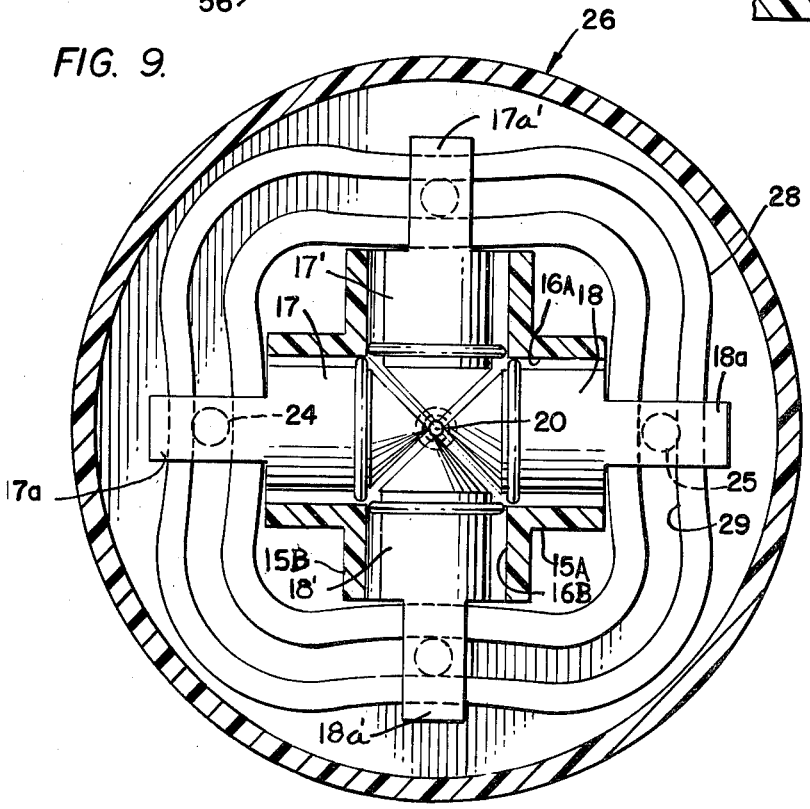
FIG. 9 is a view in section taken along line 9—9 in FIG. 1.
Figure 7:
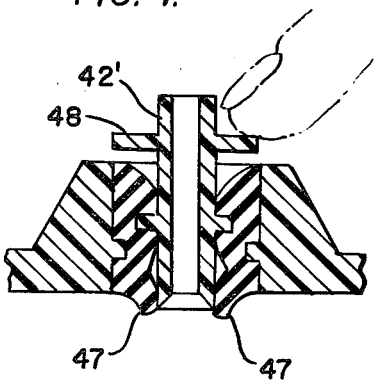
FIG. 7 is a view showing the discharge nozzle of FIG. 6 in its actuated or open position.

A second modification of the invention is indicated at **33*b* in FIG. 6, and in this form of the invention the upstanding, frusto-conically shaped projection 39' has a cylindrically shaped cavity or pocket 40' formed therein in which is received a substantially cylindrical plug 41' having yieldable closure lips 47 normally precluding communication between the interior of the package 45 and the bore 43 through discharge nozzle or stem 42'. The discharge nozzle or stem has a diametrically enlarged actuating flange 48 thereon which may be engaged to depress the discharge nozzle or stem 42' axially to force open the closure lips 47, as seen in FIG. 7. This form of the invention may be used, for example, with a douche or enema, wherein the douche or enema would be attached to the discharge nozzle or stem 42'** and the assembly pressed against the user's body to depress the discharge nozzle or stem to the position shown in FIG. 7 to release the pressurized contents from the package 45.

Figure 8:
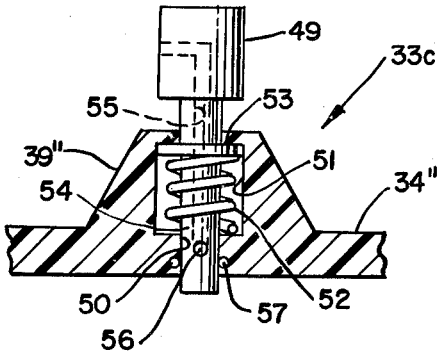
FIG. 8 is a view similar to FIG. 6 of a further form of discharge means or nozzle for use with the invention.

A third modification of the invention is illustrated at 33c in FIG. 8, and in this form of the invention a discharge nozzle 49 is reciprocably mounted in a bore 50 through the upstanding projection 39" in the cap 34". The bore 50 is diametrically enlarged at 51 to provide a spring receiving chamber in which a coil spring 52 is received. The spring is engaged against a collar 53 on the actuating stem or shaft 54 of discharge nozzle 49 for normally maintaining it in an upwardly closed position, as illustrated in FIG. 8. The discharge nozzle has an axial passage 55 therethrough communicating with a lateral bore or opening 56 adjacent the lower end and normally spaced upwardly from an O-ring seal 57 such that communication is precluded or interrupted between the interior of package 45 and the passageway 55. This form of the invention would be used, for example, for dispensing liquids and the like, whereas the previously described forms of discharge nozzle would normally be intended for use with more viscous materials, such as foodstuffs and the like.

A fourth modification of the invention is indicated at 10' in FIG. 10 and is substantially the same as that described with reference to FIG. 1, except that the dispensing device 33d has the collapsible product containing package 58 thereof received within or surrounded by a relatively rigid sleeve 59 formed integrally with or secured to the cap 60. The package 58 is preferably snugly engaged at its sides with the inner surface of the sleeve 59 and may even be releasably or detachably bonded thereto, as by means of a tacky surface or adhesive or the like on either the package or the sleeve. Thus, it is reasonably assured that most of the pressure acting on the package will act on the bottom thereof, causing it to move upwardly in stages and progressively peeling away from the sleeve 59 as indicated in phantom lines at 58a and 58b, thereby insuring that very little, if any, product will remain trapped within the package.

Figure 11:
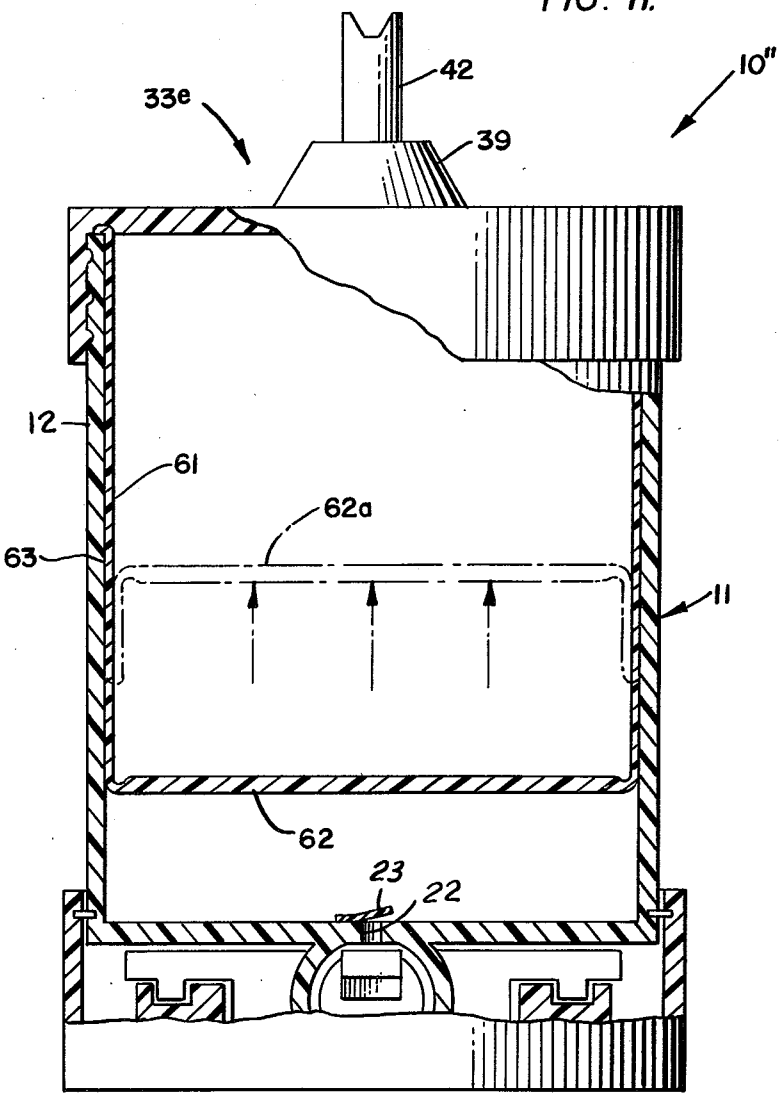
FIG. 11 is a view similar to FIG. 1 of a fifth form of the invention wherein the collapsible product containing package has a relatively rigid bottom.
Figure 10:
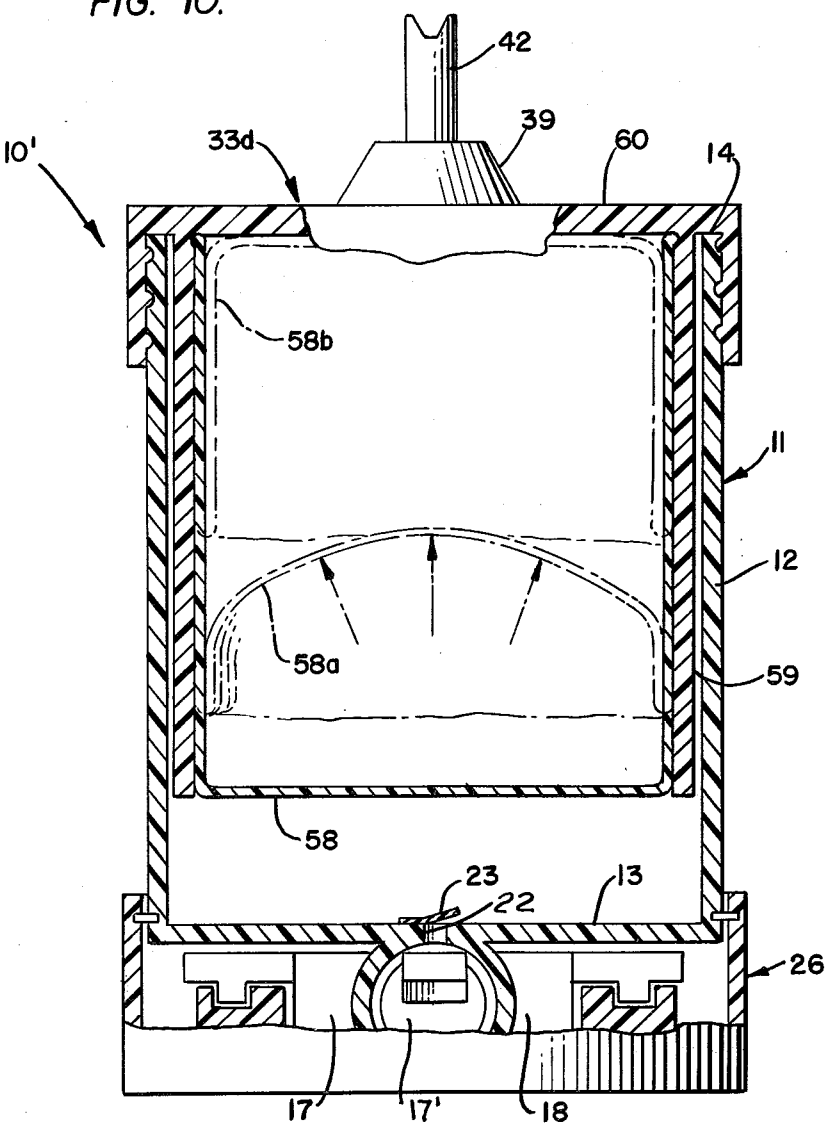
FIG. 10 is a view similar to FIG. 1 of a fourth form of the invention wherein the collapsible product containing package is surrounded by a relatively rigid sleeve.

A fifth modification of the invention is indicated generally at 10" in FIG. 11, and this form of the invention is also substantially identical to those previously described in FIGS. 1 and 10, except that the product containing package 61 of the dispensing device 33e has a relatively rigid bottom 62 and the side walls of the package 61 may be releasably attached or bonded to the side walls of container 11 by providing a tacky surface 63 on the inner surface of the side wall 12 of container 11 or on the outer surface of package 61. In this form of the invention, the rigid bottom 62 moves upwardly as indicated in phantom line at 62a, causing the side wall of the package to progressively peel away from the side wall of the container and thus acting in the nature of a piston, thereby insuring that very little, if any, product remains trapped within the package.

Figure 12:
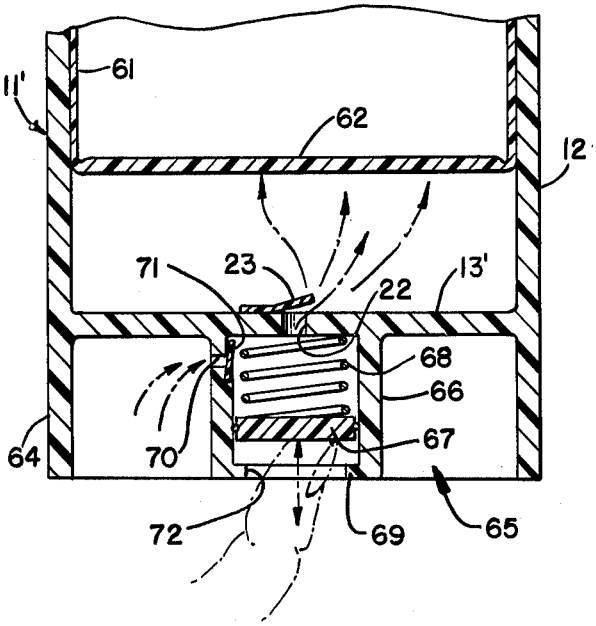
FIG. 12 is a fragmentary view in section of a sixth form of the invention wherein a different type of expansible chamber means is on the bottom of the container for pressurizing the product containing package.

A sixth modification of the invention is illustrated in FIG. 12, and in this form of the invention a package such as 61 as in the FIG. 11 embodiment is provided in a modified container 11'. The side wall 12 of the modified container 11' projects downwardly beyond the bottom wall 13' thereof to define an annular, cylindrical, depending skirt 64 which surrounds a modified expansible chamber means 65 for pressurizing the interior of the container. The expansible chamber means 65 in this form of the invention comprises a cylinder 66 depending from the bottom wall 13' and having a reciprocable piston 67 slidably sealed therein with the piston urged downwardly by a coil spring 68 to a position normally at rest against an inturned flange 69 on the bottom end of the cylindrical wall 66. An inlet opening 70 is formed through the side of the cylinder 66 adjacent the upper end thereof and a flap valve or other suitable closure 71 is associated with the opening 70, whereby the piston 67 may be engaged with the finger or the like by extending the finger through an opening 72 defined by the inturned flange 69 to reciprocate the piston 67 and cause air to alternately flow inwardly through opening 70 and then outwardly through opening 22 to pressurize the interior of the container 11' and thus to force discharge of product from within the package 61 when the discharge nozzle is operated.

Figure 13:
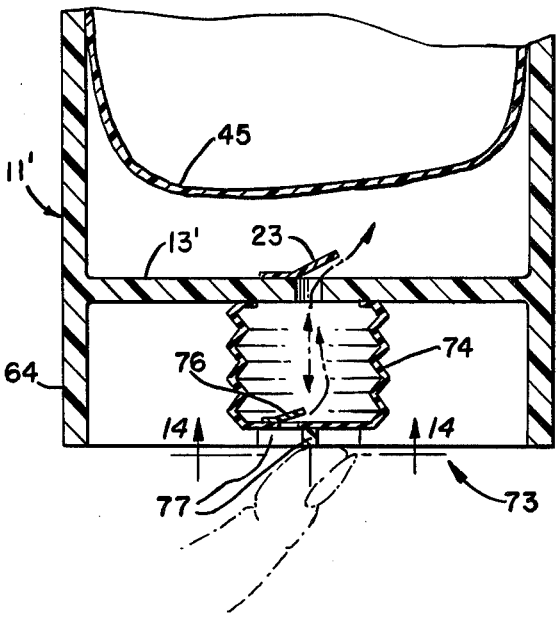
FIG. 13 is a view similar to FIG. 12 of a seventh form of the invention wherein yet a further type of expansible chamber is provided on the bottom of the container.
Figure 14:
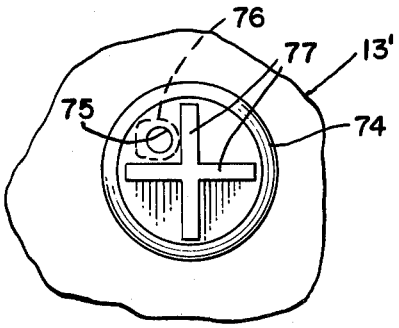
FIG. 14 is a fragmentary view taken along line 14—14 of FIG. 13.

A seventh modification of the invention is illustrated in FIGS. 13 and 14, and in this form of the invention the expansible chamber means 73 comprises a bellows 74 having an opening 75 in the end wall thereof normally closed by a flap valve or the like 76. A cross-like configuration 77 is formed on the end wall of the bellows 74 such that the finger of the user does not close the opening 75 and thereby prevent entry of the air into the bellows for subsequent pumping through opening 22 and to the interior of the container when the bellows 74 is alternately collapsed and expanded.

Figure 15:
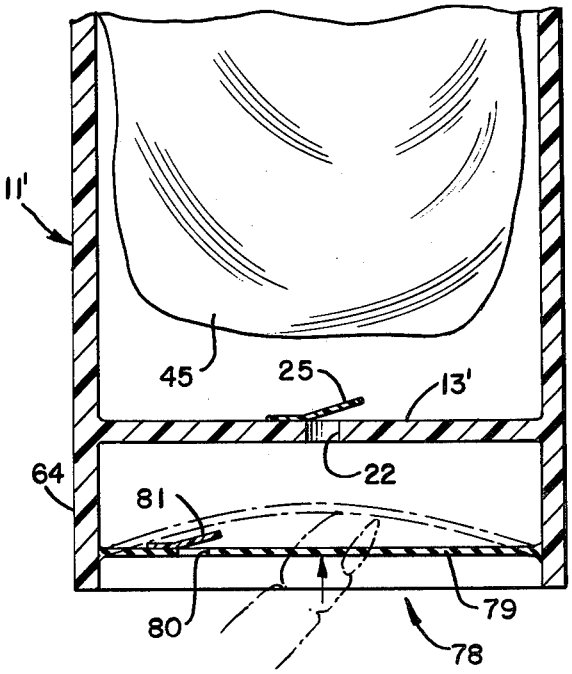
FIG. 15 is a view similar to FIGS. 12 and 13 of an eighth form of the invention wherein a still further type of expansible chamber is on the bottom of the container.

An eighth modification of the invention is illustrated in FIG. 15, and in this form of the invention the expansible chamber means 78 comprises a flexible diaphragm or the like 79 extending across the space bounded by skirt 64 and having an opening 80 therethrough normally closed by a valve 81, whereby when the diaphragm 79 is flexed, as indicated in phantom line, by applying pressure thereto with the finger or the like, air is alternately pumped into the chamber defined by the diaphragm and then outwardly thereof through opening 22 into the interior of the container 11' to pressurize the contents of package 45.

Figure 16:
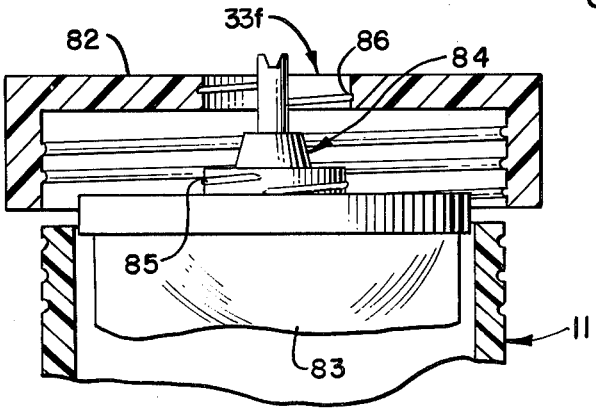
FIG. 16 is a fragmentary exploded view in section of a ninth form of the invention wherein the product containing package and product discharge member are formed together for placement as a unit in the pressurizable container, thus enabling the discharge member, as well as the product, to be maintained in an uncontaminated condition prior to use.

A ninth modification of the invention is indicated in FIG. 16, and in this form of the invention the dispensing device 33f is manufactured with the cap 82 being separate from the product containing package 83 which has the product discharge means or nozzle 84 attached thereto. A suitable fastening means, such as a threaded fitting or the like 85, is provided on the package 83 for engagement with complementary fastening means 86 in the cap 82 to secure the product containing package to the cap. The cap is then releasably secured to the container 11 in the same manner as described with reference to the previous forms of the invention. Of course, it should be understood that fastening means other than the threads 85 and 86 could be used to assemble the product containing package to the cap, if desired, and in fact, the discharge means 84 could simply be inserted through the opening in the cap 82 and a flange or the like could be provided on the upper end of the package which would be engaged between the top open end of container 11 and the cap 82 to hold the package in place when the cap is secured on the container.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. A reuseable, pressurizable, dispensing container comprising: a housing having a side wall with an open end and a closed end and defining a pressurization chamber therewithin; expansible chamber means at the closed end and connected with the pressurization chamber to pressurize the chamber; manually operable means connected with the expansible chamber means to operate the expansible chamber means; closure means on the open end of the container releasably attaching a dispensing package thereto having a collapsible product containing member received in the pressurization chamber of the container, whereby the contents of the collapsible member may be pressurized for dispensing as desired, said closure means having attaching means thereon cooperating with complementary attaching means on the housing to releasably secure the closure means to the housing open end, said closure means normally effecting an air-tight seal with said housing open end to prevent loss of pressure from the pressurization chamber; product discharge means on the package for selectively discharging product from the package under pressure when the interior of the housing is pressurized upon manipulation of the expansible chamber means; and a pressure release channel formed through and extending angularly across the attaching means and establishing fluid communication between the pressurization chamber and the atmosphere to release pressure from the pressurization chamber upon initial opening movement of the closure means, to prevent forcible displacement of the closure means from the housing by pressure in the pressurization chamber when the closure means is loosened for removal from the housing.

2. A container as in claim 1 wherein the expansible chamber means comprises a piston and cylinder, and said manually operable means is connected with the piston to reciprocate the same in the cylinder to alternately draw air into the cylinder and expel the air therefrom into the container to pressurize the interior of the container.

3. A container as in claim 2 wherein the piston and cylinder comprises a pair of opposed axially aligned cylinders and pistons reciprocable in the cylinders, said manually operable means connected with the pistons to operate them in unison toward and away from one another.

4. A container as in claim 1 wherein the product discharge means comprises a product discharge nozzle carried by the closure means for releasing the product from the member when the interior of the container is pressurized.

5. A container as in claim 4 wherein the closure means has an opening therethrough receiving the discharge nozzle of the product containing member when the product containing member is received in the container.

6. A container as in claim 5 wherein attaching means is on said closure at said opening therethrough to secure the member thereto.

7. A container as in claim 1 wherein the container side wall extends beyond the closed end thereof and the expansible chamber means and manual operator therefor are surrounded by the extended portion of the side wall.

8. A container as in claim 1, wherein the package and closure means are permanently secured together and are attached as a unit to the housing.

9. A container as in claim 1, wherein the package and closure means are normally separate from one another and attaching means are on the package and closure means for attaching the package thereto prior to attaching the closure means and package to the container, said closure means having separate attaching means thereon for attaching the package and closure means to the housing.

10. A container as in claim 9, wherein the discharge means comprises a discharge nozzle carried by the package.

11. A container as in claim 1, wherein a pressure relief valve is in the housing closed end for relieving excess pressure from the housing when the expansible chamber means is excessively operated.

12. A container as in claim 1, wherein the collapsible member is affixed to and carried by the closure means in a position such that the member extends into the housing, and a rigid sleeve carried by the closure means extending in closely surrounding, enclosing, coaxial relation with the collapsible member whereby the member is collapsed from one end thereof, thus insuring that substantially all of the product is removed therefrom.

13. A container as in claim 1, wherein the collapsible member is affixed to and carried by the closure means in a position such that the member extends into the housing and said member has a flexible side wall and a relatively rigid end wall which is only slightly smaller in diameter than the housing, whereby the pressure in the housing acts on the end wall, moving it axially in the housing similarly to a piston, resulting in the collapsible member side wall peeling away from the housing side wall, thus insuring that substantially all of the product is removed from the package.

14. A reusable, pressurizable, hand held dispensing container, comprising: a housing having a side wall with a closed end and an open end and defining a pressurization chamber therewithin; cylinder means carried by the closed end of the housing on the outside of the housing, said cylinder means having an air inlet opening thereto from atmosphere and an air outlet opening therefrom into the pressurization chamber; one way valve means controlling flow through said openings, for flow of air from atmosphere into the cylinder means and from the cylinder means into the pressurization chamber; piston means reciprocable in the cylinder means to draw air from atmosphere into the cylinder means, pressurize the air and transfer it under pressure into the pressurization chamber; rotatable piston actuating means carried by the closed end of the housing on the outside thereof, and secured to the housing by means permitting rotation between the actuating means and the housing, said actuating means having a cam means therein engaged with said piston means to reciprocate said piston means when the actuating means is rotated relative to the housing; closure means releasably attached to the open end of the housing for gaining access to the interior of the housing and sealed relative thereto to prevent loss of pressure developed in the pressurization chamber; a disposable, collapsible, flexible pouch containing product to be dispensed, carried by the closure means in a position to depend into the pressurization chamber when the closure means is attached to the housing, and being removable from the housing along with the closure means; and a product dispensing nozzle projecting through the closure means and communicating with the interior of the pouch, for enabling discharge of product from the pouch when the interior of the pressurization chamber is pressurized.

* * * * *